US008757790B2

(12) United States Patent
Masuda et al.

(10) Patent No.: US 8,757,790 B2
(45) Date of Patent: Jun. 24, 2014

(54) PRINTING APPARATUS

(71) Applicant: Canon Kabushiki Kaisha, Tokyo (JP)

(72) Inventors: Shuichi Masuda, Yokohama (JP); Hideyuki Nozawa, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/683,306

(22) Filed: Nov. 21, 2012

(65) Prior Publication Data

US 2013/0135408 A1 May 30, 2013

(30) Foreign Application Priority Data

Nov. 25, 2011 (JP) ..... 2011-256949
Aug. 15, 2012 (JP) ..... 2012-180226

(51) Int. Cl.
*B41J 2/01* (2006.01)

(52) U.S. Cl.
USPC ..... 347/102; 347/19

(58) Field of Classification Search
CPC ..... B41J 11/002; B41J 2/205
USPC ..... 347/19, 102
See application file for complete search history.

(56) References Cited

U.S. PATENT DOCUMENTS 7,421,221 B2 * 9/2008 Suzuki ..... 399/49
2011/0134445 A1 * 6/2011 Matsuzawa et al. ..... 358/1.5

FOREIGN PATENT DOCUMENTS

JP 2008-254221 10/2008

OTHER PUBLICATIONS

Machine translation of JP 2008-254221 A. (JP 2008-254221 A was published on Oct. 23, 2008.).*
U.S. Appl. No. 13/683,316, filed Nov. 21, 2012, by Junya Kosuge et al.

* cited by examiner

*Primary Examiner* — Alessandro Amari
*Assistant Examiner* — Justin Seo
(74) *Attorney, Agent, or Firm* — Fitzpatrick, Cella, Harper & Scinto

(57) ABSTRACT

There is provided a printing apparatus capable of improving total throughput of color measurement and preventing damage to a printed image. Therefore a colorimetric housing 180 including a drying unit 140 or a discharge guide 16 is structured to be movable upwards and downwards, and a distance between the drying unit 140 and the discharge guide 16 is changed corresponding to an operational mode or a kind of a sheet.

11 Claims, 12 Drawing Sheets

PRINTING APPARATUS

BACKGROUND OF THE INVENTION

1. Field of the Invention

The present invention relates to a printing apparatus provided with a colorimetric apparatus for measuring a colorimetric pattern printed on a sheet.

2. Description of the Related Art

There are some cases where an inkjet type printing apparatus is provided with a colorimetric function. According to such an inkjet type printing apparatus, a print head scans in a main scan direction to perform printing, and a color image is measured with the aim of color calibration or the like after printed. The result of color data obtained by the color measurement is reflected in image printing thereafter, making it possible to obtain desired color reproduction.

A color patch is required to be sufficiently dried for obtaining the desired color data, and therefore there is a problem that it takes time to transfer from completion of printing to start of color measurement. Therefore, Japanese Patent Laid-Open No. 2008-254221 proposes a technique that a drying unit for forcibly implementing the drying is provided downstream of a printing unit and a colorimetric measurement unit, wherein the forced drying is implemented before the color measuring, thus shortening the time to transfer from the completion of the printing to the start of the color measurement.

In the apparatus disclosed in Japanese Patent Laid-Open No. 2008-254221, the drying unit is arranged to a conveyed sheet in such a manner that an interval direction of the drying unit to the sheet is fixed. Therefore, there is a possibility that when a front end of the sheet is introduced under the drying unit, the sheet is rubbed with a part of the drying unit, and an image in a state where ink is before being dried and is not yet dried is damaged. Particularly when the sheet having a strong curling characteristic is used, the possibility of the damage to the image becomes greater.

For avoiding the damage, there is considered the structure that a relative distance between the drying unit and the sheet is variable. However, since a drying range varies by varying the relative distance, when the drying row number which can be dried at one time is fixed, losses in the drying row number arranged within the drying range or non-dried patch rows are generated to affect total throughput of the color measurement and color stable accuracy (color measurement accuracy) at measuring.

SUMMARY OF THE INVENTION

Therefore an object of the present invention is to provide a printing apparatus which has the structure of being capable of preventing damage to a printed image, as well as improving total throughput of color measurement and colorimetric accuracy by selecting an efficient drying control.

A printing apparatus according to the present invention, comprises a printing unit configured to perform printing on a sheet, a colorimetric measurement unit, provided downstream of the printing unit in a conveyance direction of the sheet, configured to perform colorimetric measurement of the sheet, a drying unit, provided downstream of the colorimetric measurement unit in the conveyance direction, configured to perform drying of the sheet subjected to the printing by the printing unit, and a mechanism for varying a distance between the drying unit and the sheet, wherein the distance between the drying unit and the sheet is set based upon at least one of an operational mode and a kind of the sheet to be used.

According to the present invention, there can be realized the printing apparatus which can prevent the damage to the printed image and improve the total throughput of the color measurement and the colorimetric accuracy by the efficient drying control.

Further features of the present invention will become apparent from the following description of exemplary embodiments (with reference to the attached drawings).

DESCRIPTION OF THE EMBODIMENTS (First Embodiment)

Hereinafter, a first embodiment according to the present invention will be explained with reference to the accompanying drawings.

(Explanation of an Entire Printing Apparatus)

Figure 1:
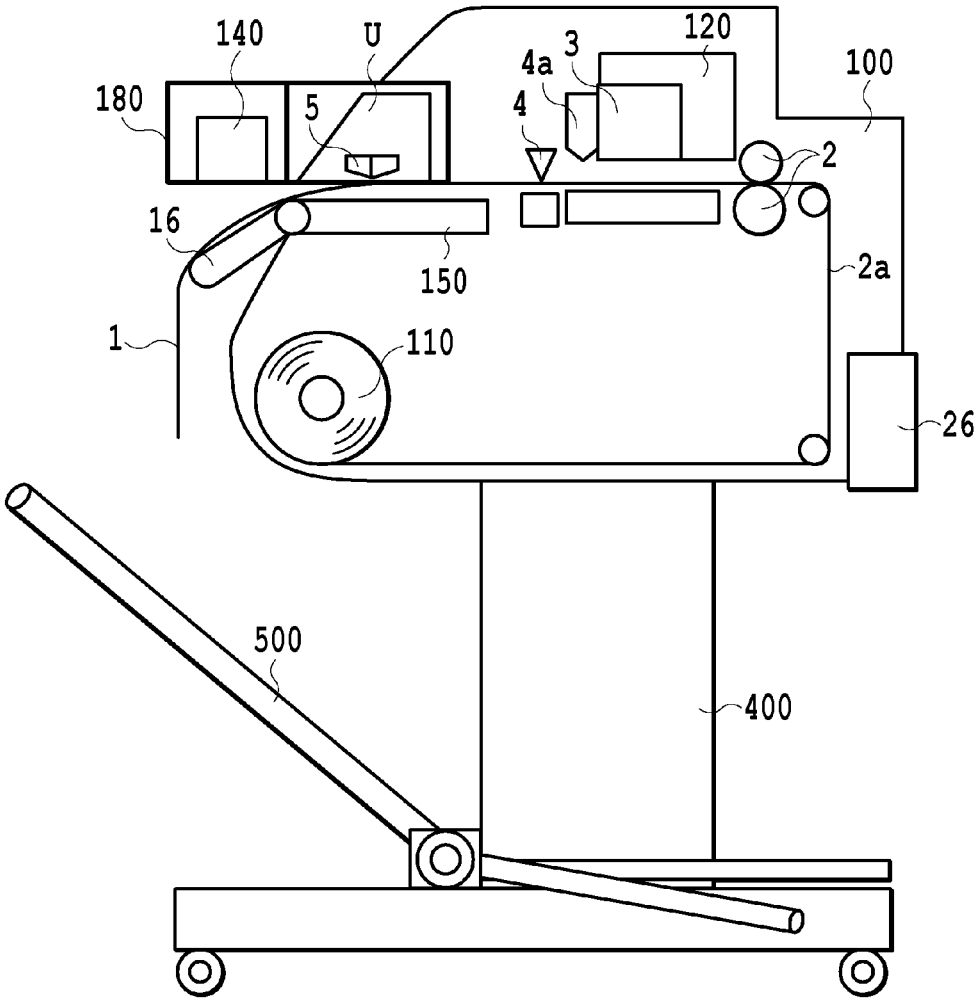
FIG. 1 is a side view showing a structure example of an inkjet printing apparatus.

FIG. 1 is a side view showing the structure example of an inkjet printing apparatus capable of printing on a sheet in a relative large size, such as A0-size or B0-size by JIS according to the present embodiment. The inkjet printing apparatus is structured in such a manner that a printing apparatus 100 and a stand 400 are capable of being separated. Further, a sheet accommodating apparatus 500 is mounted to the stand 400.

The printing apparatus 100 is provided with a feeding unit 110 at the lower part, and a printing unit 3, a printing unit holding body 120, a colorimetric measurement unit U, and a drying unit 140 horizontally disposed around the center. A colorimetric reference surface 150 as a reference surface of the color measurement is provided under the color measurement unit U. At the color-measuring by the colorimetric measurement unit U, a colorimetric housing 180 goes down from a retreat position to a measurement position in such a manner as to press a sheet 1 guided by the colorimetric reference surface 150. A colorimetric sensor 5 provided inside the colorimetric measurement unit U reads color patches printed over a plurality of rows on the sheet 1 while driving in a scan direction.

Desired data is obtained by this reading, and the colorimetric housing 180 is retreated to the retreat position after having obtained the data. In addition, a discharge guide 16 (guide unit) is provided under the drying unit 140 to be structured downstream of the colorimetric measurement unit U in the discharge direction as much as possible within a range in which no influence is exerted on a colorimetric operation. A cutter 4 is provided for cutting the sheet 1, and cuts a cutting part of the sheet 1 on which the printing is completed in the printing apparatus 100. The cut sheet 1 is discharged to the sheet accommodating apparatus 500. In the present embodiment, the feeding unit 110 is provided at the lower part to the printing apparatus 100, but is not limited thereto, and may be provided at an upper part or at a central part to the printing apparatus 100.

In this structure, in a case of printing in the inkjet printing apparatus, after setting the roll-shaped sheet 1 to the feeding unit 110 for feeding, the conveyance direction of the sheet 1 is changed at a U-turn part 2*a* to cause the sheet 1 to be conveyed to a conveyance roller pair 2 and the printing unit 3.

Figure 2:
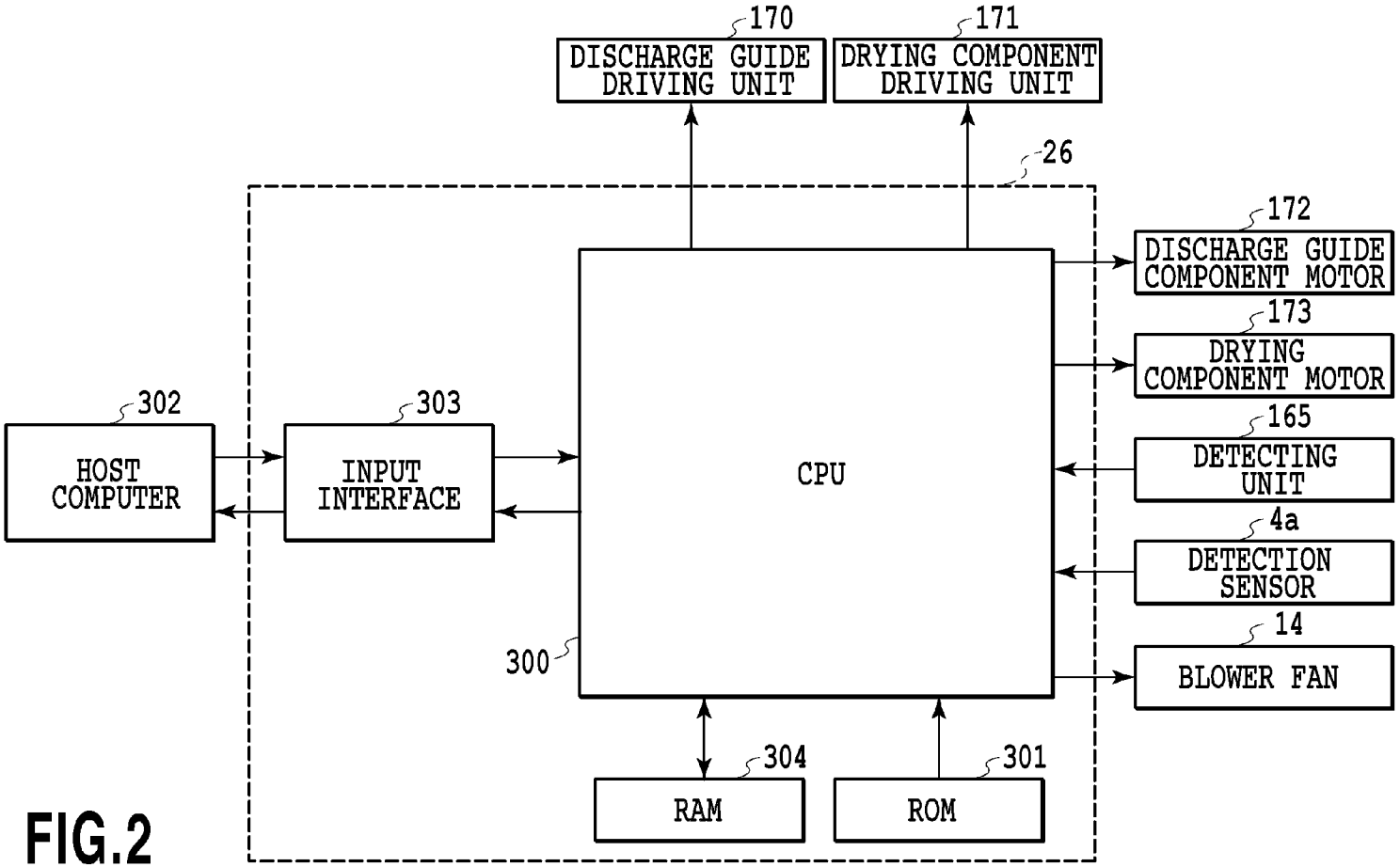
FIG. 2 is a block diagram showing a system structure of the inkjet printing apparatus.

FIG. 2 is a block diagram showing the system structure of the inkjet printing apparatus according to the present embodiment. When the sheet 1 is set to the feeding unit 110 to be fed, a user inputs a kind and size of the sheet 1 and besides, information required for printing through an input interface 303 from a host computer 302 to a CPU 300 to start with the printing.

The CPU 300 is structured to write in or read out the kind and size of the sheet 1 and besides, the information required for printing, to/from a RAM 304. In addition, programs of the printing by the printing unit 3, the drying by the drying unit 140, the driving of the discharge guide 16, the driving of the drying unit 140, the blower fan 14 and the like are in advance stored in a ROM 301. The input interface 303, the CPU 300, the ROM 301, and the RAM 304 are accommodated as a printing control apparatus 26 inside the printing apparatus 100.

At printing, the printing apparatus 100 conveys the sheet 1 horizontally, and a detecting sensor 4*a* for confirming presence/absence of the sheet 1 by detecting a front part of the sheet 1 confirms presence/absence of the sheet 1. In addition, after confirming that the sheet 1 is present, the printing apparatus 100 moves the printing unit 3 in the main scan direction to eject ink, thus printing predetermined information on the sheet 1. It should be noted that the structure and a series of the operations of the above printing apparatus are used in common to second, third, and fourth embodiments except for the difference in sheet 1*a* or sheet 1*b*.

(Explanation of a Mechanism for Changing a Position of the Drying Unit)

The present embodiment is structured to cause the drying unit 140 to move upwards and downwards to be capable of changing an interval (distance) to the sheet 1. Hereinafter, a mechanism example for driving the drying unit 140 upwards and downwards will be explained.

Figure 3A:
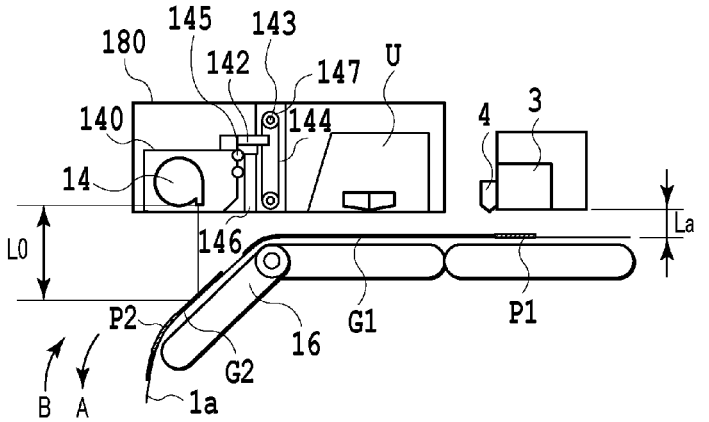
FIG. 3A is a diagram showing a printing unit, a colorimetric housing, and a discharge guide.

FIG. 3A to FIG. 3D are diagrams each showing the printing unit 3, the colorimetric housing 180, and the discharge guide 16 according to the present embodiment. In FIG. 3A, the colorimetric measurement unit U is positioned to and is accommodated in the colorimetric housing 180 configured of a sturdy frame structure. In addition, the colorimetric housing 180 is provided with a plate 147 for fixing a drying unit motor 173 for connecting upper and lower pulleys 143 and the pulleys 143, and a lock mechanism (not shown) for positioning the drying unit 140 to a first stop position to be locked therein.

The upper and lower pulleys 143 are connected with each other by, for example, a metallic wire 144 or the like using a strong material. A support part 142 of the drying unit 140 is connected and fixed to the metallic wire 144 at a desired position. The drying unit 140 is provided with rollers 145, and makes contact with a rail 146 fixed to the colorimetric housing 180 through the rollers 145.

Such a structure enables the drying unit 140 to be driven, and the locking mechanism fixing the drying unit 140 is first released in response to a command from the CPU 300. Thereafter, the drying unit motor 173 connected to the pulley 143 starts to drive to drive the metallic wire 144 in a given direction, so that the support part 142 connected and fixed to the metallic wire 144 starts also to drive integrally. The driving of the support part 142 causes the drying unit 140 connected thereto to drive along the rail 146 through the rollers 145.

In addition, it is possible to drive the drying unit 140 in a direction reverse to the above direction by switching the rotational direction of the drying unit motor 173 to the direction reverse to the above direction. It should be noted that since the blower fan 14 is positioned and fixed to the drying unit 140, the upper and lower driving of the drying unit 140 also causes the upper and lower driving of the blower fan 14. As a result, a relative distance (interval) between a blowoff opening of the blower fan 14 and the surface of the sheet 1*a* is set as L0, which is a first stop position.

(Explanation of a Drying Process and a Colorimetric Process)

The drying process and the colorimetric process according to the present embodiment will be explained with reference to FIG. 3A to FIG. 3D. FIG. 3A is a diagram showing a state where the printing to the sheet 1*a* is completed in the printing unit 3. In the sheet 1*a*, arbitrary images G1 and G2, an arbitrary color patch P1 on which color data of the image G1 is printed, and an arbitrary color patch P2 on which color data of the image G2 is printed, are printed (formed on the sheet) over a plurality of rows. The sheet 1*a* is a sheet having a weak curling characteristic.

At this time, a position where a relative distance (first distance) from the blowoff opening of the blower fan 14 included in the drying unit 140 to the sheet 1*a* guided along a paper-through surface in the discharge guide 16 becomes L0 is defined as a first stop position. In addition, a relative distance between the colorimetric measurement unit U and the sheet 1*a* guided on the paper-through surface of the colorimetric reference surface 150 at this time is defined as La. Here, it is preferable also in view of saving sheets that a section of the sheet 1*a* on which any color patch is printed is arbitrarily determined by a user without being affected by a position of printing an image.

For example, it is preferable that, as the color patch P1, the printing is performed in a space after the image G1 or as the color patch P2, the printing is performed in a space lining up to the image G2 in the scan direction. It should be noted that in the figure, an arrow A indicates a conveyance direction (feeding toward the downstream side) of the sheet 1*a* at printing in the printing unit 3, and an arrow B indicates a conveyance direction (feeding toward the upstream side or called also back-feeding) of the sheet 1*a* at drying in the drying unit 140 and measuring in the colorimetric measurement unit U.

Figure 3B:
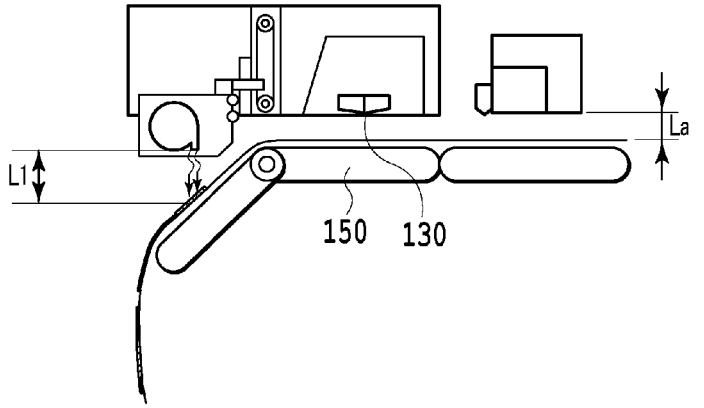
FIG. 3B is a diagram showing the printing unit, the colorimetric housing, and the discharge guide.

When the drying process starts, the lock mechanism for fixing the drying unit 140 is released based upon an instruction from the CPU 300 to start driving of the drying unit motor 173, and, as shown in FIG. 3B, the drying unit 140 including the blower fan 14 starts to go down along the rail 146 from the first stop position. The drying unit 140 stops at a second stop position where a relative distance (second distance) from the blowoff opening of the blower fan 14 to the sheet 1*a* having a weak curling characteristic guided along the paper-through surface of the discharge guide 16 is defined as L1, so that the blowing from the blower fan 14 is supplied to the sheet 1*a*.

At this time, the relative distance between the colorimetric measurement unit U and the sheet 1*a* guided on the paper-through surface of the colorimetric reference surface 150 is defined as La. This movement of the drying unit 140 causes the relative distance from the blowoff opening of the blower fan 14 to the sheet 1*a* guided along the paper-through surface of the discharge guide 16 to change from L0 to L1 to be set.

Here, since relative distance L1<relative distance L0, the wind speed of the blowing to the sheet 1*a* from the blower fan 14 at drying is ensured to be higher, making it possible to shorten a drying time of the color patch printed on the sheet 1*a*. In addition, at the same time with the drying process start, the sheet 1*a* is conveyed in a direction of an arrow A to a position where the color patch P1 comes under the blowoff of the blower fan 14 for drying. It should be noted that the blowing start from the blower fan 14 may be made in a state where the drying unit 140 is in the first stop position, wherein the blowing start and the driving of the drying unit 140 are performed in parallel, thereby making it possible to further shorten the drying time. The second stop position is a position calculated in such a manner that even if the colorimetric housing 180 drives downwards at the time of performing a colorimetric operation by the colorimetric measurement unit U (at color-measuring), the contact of the colorimetric housing 180, the drying unit 140, and the colorimetric measurement unit U with the sheet 1*a* can be avoided, and the wind speed to the sheet 1*a* can be sufficiently ensured.

Figure 3C:
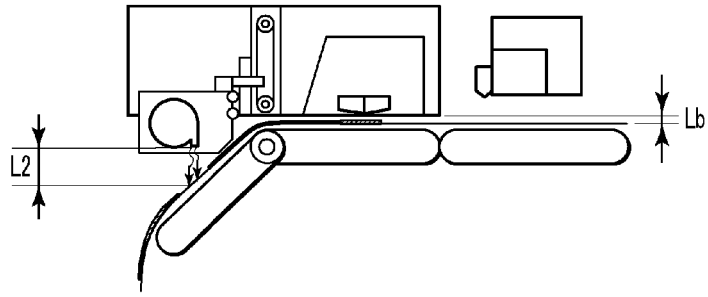
FIG. 3C is a diagram showing the printing unit, the colorimetric housing, and the discharge guide.

The arbitrary color patch P1 on which the drying is completed is, for measuring by the colorimetric measurement unit U, positioned under the measurement position 130 by feeding the sheet 1*a* in a direction of an arrow B by back-feeding. Thereafter, as shown in FIG. 3C, the colorimetric housing 180 goes down to the measurement position where the relative distance between the colorimetric part of the colorimetric measurement unit U and the color patch P1 becomes Lb, wherein the color measurement of the color patch P1 (printed object) is performed by the colorimetric measurement unit U. After the color measurement is completed, the colorimetric housing 180 retreats to a retreat position of the relative distance La.

Figure 3D:
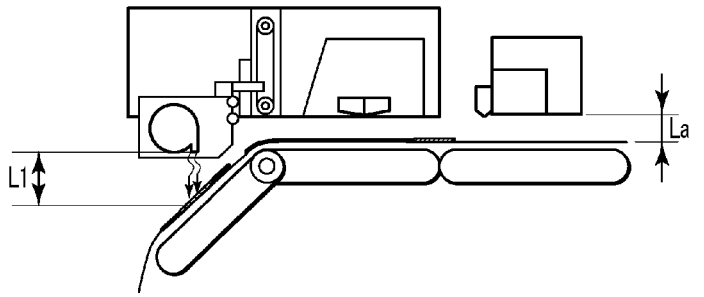
FIG. 3D is a diagram showing the printing unit, the colorimetric housing, and the discharge guide.

Further, thereafter, as shown in FIG. 3D, the sheet 1*a* is conveyed in a direction of the arrow B by back-feeding until a position where the color patch P2 comes under the blowoff of the blower fan 14 for drying the color patch P2. After the drying is completed, in the same way with the color patch P1, the colorimetric housing 180 drives the color patch P2 conveyed (step feeding by back-feeding) to the measurement position 130 to the relative distance Lb, and thereby the color measurement by the colorimetric measurement unit U is performed.

In a case where the drying process and the colorimetric process are executed at the same time, the relative distance from the blowoff opening of the blower fan 14 to the sheet 1*a* guided along the paper-through surface of the discharge guide 16 is changed to a third stop position from the relative distance L1 to the relative position L2 to be set. Here, since relative distance L2<relative distance L1, the wind speed of the drying onto the surface of the sheet 1*a* is ensured to be higher, which assists in shortening the drying time of the color patch. The measurement position where the relative distance between the colorimetric part of the colorimetric measurement unit U and the color patch P1 becomes Lb and the relative distance from the blower fan 14 to the sheet 1*a* guided along the paper-through surface of the discharge guide 16 are in advance set and stored in an information storage unit inside or outside the printing apparatus.

(Explanation of a Discharging Process)

The flow to a point of discharging the sheet 1*a* on which the drying process and the colorimetric process are completed and the color measurement is performed will be explained. After a final color patch printed on the sheet 1*a* is measured, the colorimetric housing 180 retreats from a measurement position as the relative distance Lb to a retreat position as the relative distance La. At this time, the relative distance L2 in the drying unit 140 is changed to the relative distance L1 to be set. Thereafter, the drying unit 140 retreats from the second stop position as the relative distance L1 to the first stop position as the relative distance L0.

Therefore, even in a case where the sheet 1*a* has a more or less curling characteristic, the sheet 1*a* can be smoothly discharged without interference with the drying unit 140. Therefore, the sheet 1*a* is conveyed in a direction of the arrow A, and when the rear end of the sheet 1*a* comes to a preset cutting position, the sheet 1*a* is cut. The cut, measured sheet 1*a* is guided by the discharge guide 16, and is accommodated in the sheet accommodating apparatus 500.

In a range where there is no interference between the sheet 1*a* and the drying unit 140, the first stop position of the drying unit 140 may be set to a relative distance L0' (not shown) meeting a condition of relative position L1<relative distance L0'<relative position L0, as an initial state. According to such a first stop position, since the driving amount of the drying unit 140 is minimized, it is possible to prolong unit lifetime of the pulley 143, the metallic wire 144, the drying unit motor 173, or the like. Further, since it is possible to suppress also the driving power, it has an advantage of saving energy.

In this way, the drying unit 140 or the colorimetric housing 180 is structured to be movable upwards and downwards. That is, the drying unit 140 or the colorimetric housing 180 goes down to a predetermined position at drying or at measuring for each of the operational modes, and at discharging, is retreated to prevent interference with the sheet. This structure can realize the printing apparatus which is capable of improving the total throughput of the color measurement, and also preventing the damage to the printed image.

(Second Embodiment)

Hereinafter, a second embodiment in the present invention will be explained with reference to the drawings. It should be noted that since a basic structure of the present embodiment is the same as that of the first embodiment, a characteristic structure thereof only will be hereinafter explained. An embodiment in a case of drying a sheet having a weak curling characteristic by changing a position of the discharge guide will be explained in the present embodiment. The first embodiment shows an example where the relative distance from the blowoff opening of the blower fan 14 to the sheet 1*a* guided along the paper-through surface of the discharge guide 16 is set by changing the position of the drying unit 140. In the present embodiment, a structure example of setting the relative distance by changing a position of the discharge guide 16 will be explained.

(Explanation of a Mechanism for Changing a Position of the Discharge Guide 16)

Figure 4A:
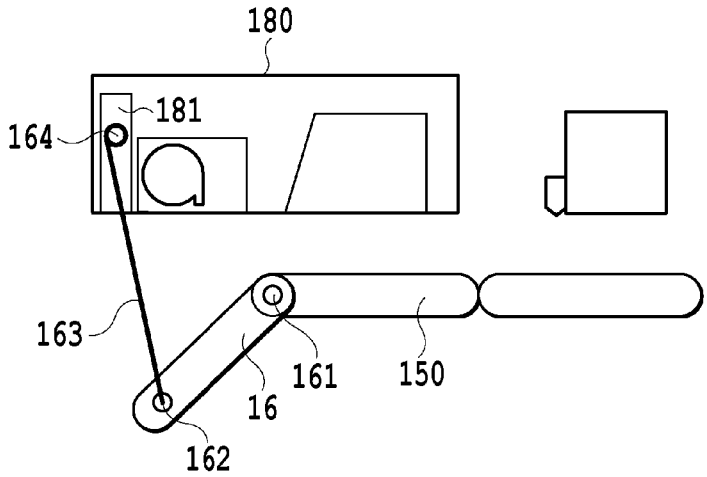
FIG. 4A is a diagram explaining a change in a position of the discharge guide.
Figure 4B:
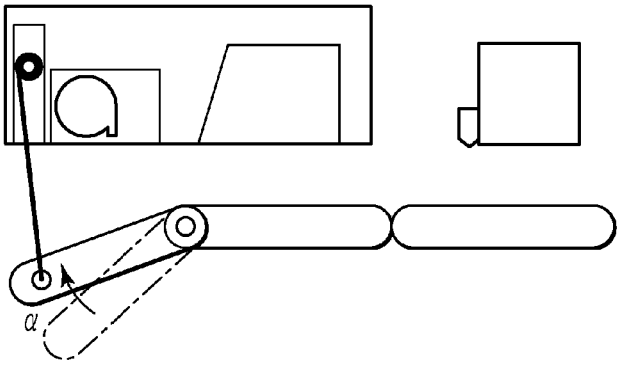
FIG. 4B is a diagram explaining a change in a position of the discharge guide.
Figure 4C:
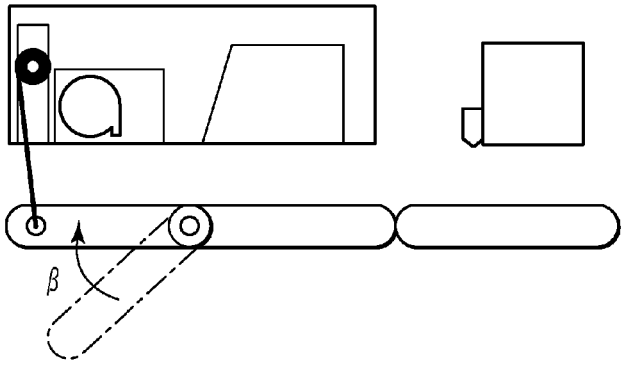
FIG. 4C is a diagram explaining a change in a position of the discharge guide.

FIG. 4A to FIG. 4C are diagrams explaining a change in a position of the discharge guide 16 according to the present embodiment. In FIG. 4A, the discharge guide 16 is supported by a shaft 161 to be rotatable to the reference surface 150. A frame 181 of the colorimetric housing 180 is provided with a discharge guide motor 172 (refer to FIG. 2), and a rotational unit 164 of the discharge guide motor 172 is connected to a belt 163. The rotational unit 164 is provided with a holder (not shown) for rewinding and holding the belt 163.

Further, the belt 163 is fixed to a belt-fixing unit 162 provided at a front end of the discharge guide 16 in the discharge downstream side. For creating a degree of freedom at an angle composed by a straight line of the belt 163 and the paper-through surface of the discharge guide 16, the belt-fixing unit 162 is axially supported by the discharge guide 16. According to this structure, in a case of rotating the discharge guide 16 toward the colorimetric housing 180, a clockwise rotation of the rotational unit 164 by the discharge guide motor 172 in FIG. 4A causes the belt 163 to be rewound on the holder of the rotational unit 164. Therefore, as shown in FIG. 4B, a length of the belt rotational unit 164 to the belt-fixing unit 162 becomes short, and the discharge guide 16 is rotated by an angle of $\alpha$ around the shaft 161. Further continued rotation of the rotational unit 164 enables the discharge guide 16 to rotate by an angle of $\beta$ as shown FIG. 4C.

(Explanation from End of Printing to Completion of Drying and Color-Measuring Processes)

Figure 5A:
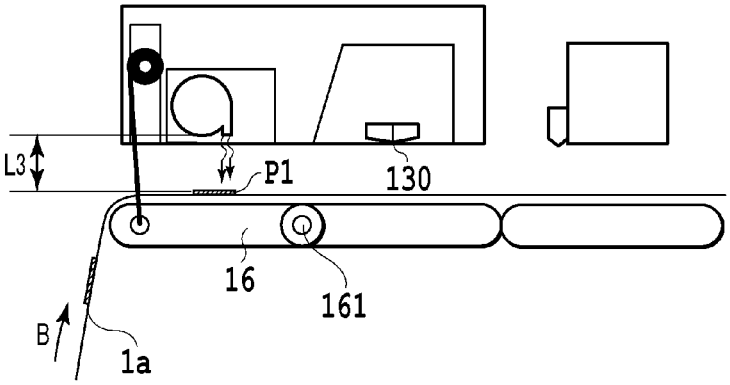
FIG. 5A is a diagram explaining a change in a position of the discharge guide.
Figure 5B:
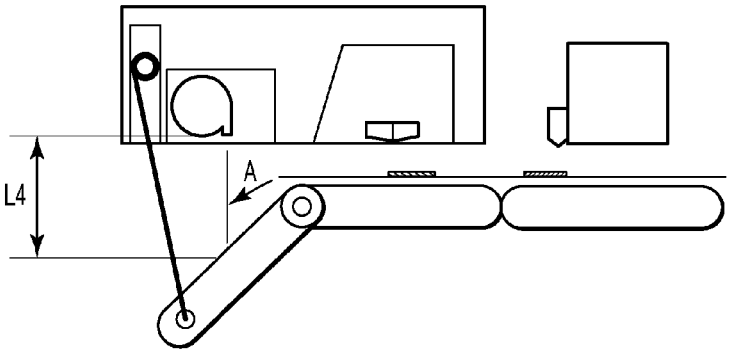
FIG. 5B is a diagram explaining a change in a position of the discharge guide.

FIG. 5A and FIG. 5B are diagrams explaining a change in a position of the discharge guide 16 according to the present embodiment. As described above, an example of setting a relative distance between the blowoff opening of the blower fan 14 and the sheet 1*a* guided along the paper-through surface of the discharge guide 16 by changing the position of the discharge guide 16 will be explained with reference to FIG. 4C, FIG. 5A and FIG. 5B.

When the printing on the sheet 1*a* is completed, as shown in FIG. 4C and FIG. 5A, the discharge guide 16 rotates by an angle of $\beta$ around the shaft 161, and stops in a first stop position where the relative distance between the blowoff opening of the blower fan 14 and the sheet 1*a* becomes L3. The relative distance L3 is a distance sufficient for drying the color patch printed on the sheet 1*a*, and is a parameter in advance set in a printing control apparatus 26.

As a result, since the position of the color patch P1 becomes close to the blowoff opening of the blower fan 14, it is possible to shorten the drying time of the color patch P1. After the drying completion of the color patch P1, the sheet 1*a* is conveyed by a given quantity in a direction of an arrow B in such a manner that the color patch P1 comes to a measurement position 130 of the colorimetric measurement unit U, and stops therein, wherein the color measurement by the colorimetric measurement unit U according to the first embodiment is performed. Thereafter, the drying and colorimetric processes are executed also to the color patch P2.

(Explanation from Completion of the Drying Process and the Colorimetric Process to Discharge)

When the color measurement of the final color patch P2 is completed, as shown in FIG. 5B, the discharge guide 16 is rotated around the shaft 161 and is stopped to the second stop position where the relative distance between the paper-through surface of the discharge guide 16 and the blowoff opening of the blower fan 14 becomes L4. Thereby it is possible to discharge the sheet 1*a* to a desired position in the sheet accommodating apparatus 500 (refer to FIG. 1). Entering into the discharging process, the sheet 1*a* is conveyed in a direction of an arrow B, and when the rear end of the sheet 1*a* comes to the preset cutting position, the sheet 1*a* is cut. The cut, measured sheet 1*a* is guided in a direction of an arrow A on the paper-through surface of the discharge guide 16, drops by gravity, and is discharged to a desired position in the sheet accommodating apparatus 500.

In FIG. 5A, the straight line formed by the paper-through surface of the discharge guide 16 during the drying process is shown to be horizontal to the straight line formed by the paper-through surface of the reference surface 150, but an arrangement between the discharge guise 16 and the reference surface 150 is not limited thereto. That is, the discharge guide 16 may be rotated so that the relative distance becomes a relative distance L3' (relative distance L3'<relative distance L3) where the paper-through surface of the discharge guide 16 becomes close to the blowoff opening of the blower fan 14. In this case, it is possible to further shorten the drying time. In addition, in reverse, the discharge guide 16 may be rotated and positioned to the relative distance L3' where a condition of relative distance L3<relative distance L3'<relative distance L4 is met. In this case, since it is possible to minimize rotation of the discharge guide 16, lifetime of the unit contributing to the rotation can be extended and the driving power can be suppressed, thus creating an advantage of saving energy.

In this way, the discharge guide 16 is structured to be rotatable, and further, the colorimetric housing 180 is structured to be movable upwards and downwards. Accordingly, each of them is moved to a predetermined position at drying or at measuring, and at discharging, is retreated to prevent interference with the sheet. Thereby there can be realized the printing apparatus capable of improving the total throughput of the color measurement and preventing the damage to the printed image.

(Third Embodiment)

Hereinafter, a third embodiment in the present invention will be explained with reference to the drawings. It should be noted that since a basic structure of the present embodiment is the same as that of the first embodiment, a characteristic structure thereof only will be hereinafter explained. An embodiment in a case of drying a sheet of a kind having a strong curling characteristic by changing a position of the drying unit will be explained in the present embodiment.

In the first and second embodiments, there is explained an example of setting the relative distance between the blowoff opening of the blower fan 14 and the sheet 1*a* guided along the paper-through surface of the discharge guide 16 in a case where the drying unit 140 or the discharge guide 16 rotates in the sheet 1*a* having the weak curling characteristic. In the present embodiment, there will be explained a structure example where a sheet 1*b* having a strong curling characteristic is dried by changing a position of the drying unit 140 to shorten the drying time.

(Structure Explanation of the Discharge Guide 16)

Figure 6A:
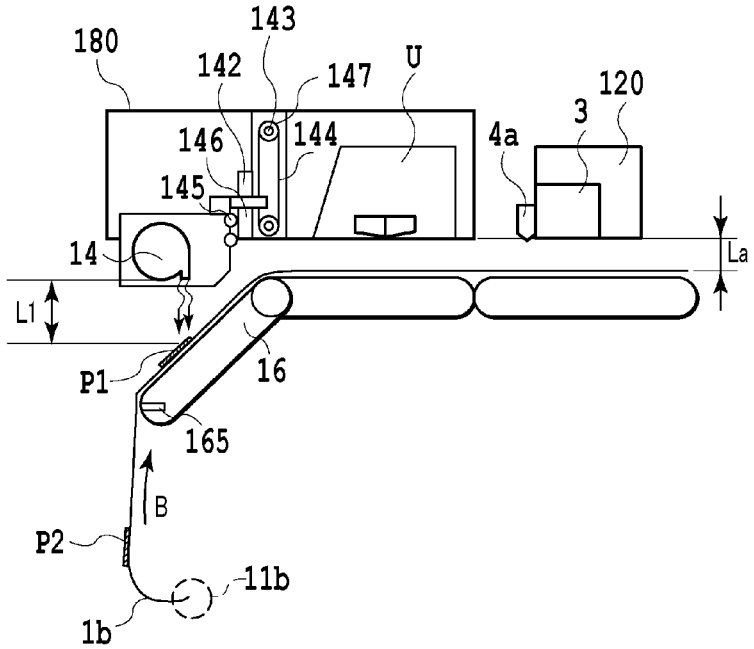
FIG. 6A is a diagram showing the movement of a blower fan.
Figure 6B:
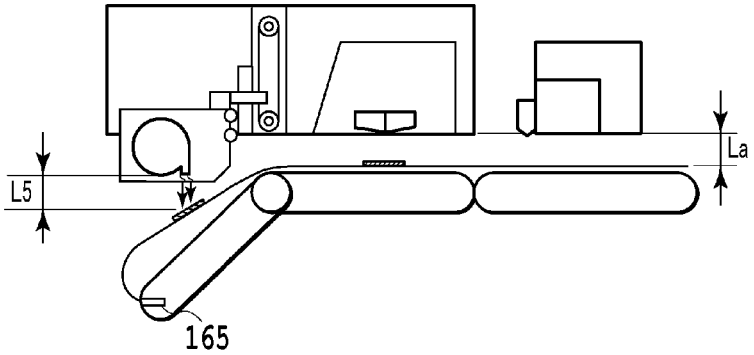
FIG. 6B is a diagram showing the movement of the blower fan.
Figure 6C:
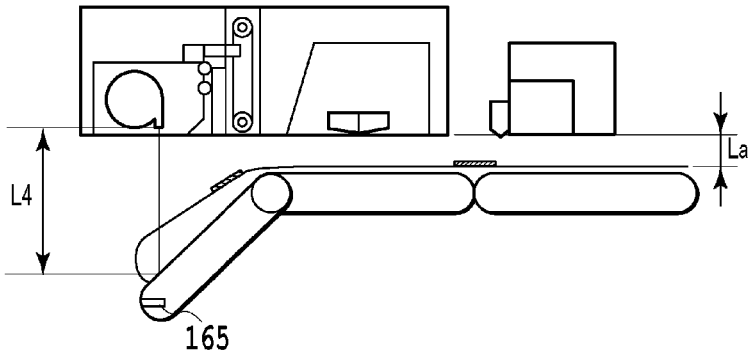
FIG. 6C is a diagram showing the movement of the blower fan.

FIG. 6A to FIG. 6C are diagrams showing the movement of the blower fan 14 according to the present embodiment. FIG. 6A shows a state where the drying unit 140 is driven to the second stop position as the relative distance L1 by the unit shown in the first embodiment to blow in, for drying the color patch P1 printed on the sheet 1*b* having the strong curling characteristic by the drying unit 140.

In the present embodiment, a sheet detecting unit 165 is provided at an end of the discharge guide 16 in the discharge downstream side. An example of the sheet detecting unit 165 includes a photoelectric sensor in which light emitted is reflected on an object, and the reflected light is received, thus detecting presence/absence of the object based upon a change in light-received amount. By thus providing the sheet detecting unit 165, during a period in which the sheet 1*b* is guided on the paper-through surface of the discharge guide 16, the emitted light from the sheet detecting unit 165 is reflected on the backside of the sheet 1*b*, which is received by the sheet detecting unit 165 to create a state where the light-received amount is large.

On the other hand, since the reflected light becomes in a state of being not received as soon as a strong curling end 11*b* of the sheet 1*b* passes through the sheet detecting unit 165, the light-received amount onto the sheet detecting unit 165 is remarkably reduced, and it is detected that there exists no object above the sheet detecting unit 165. It should be noted that, as shown in FIG. 2, when the result of the detection by the sheet detecting unit 165 is input to the CPU 300, the CPU 300 controls the drying unit motor 173 and a drying unit driving unit 171 to drive the drying unit 140 to be described later.

FIG. 6B shows a state where the end 11*b* of the sheet 1*b* arrives at the sheet detecting unit 165 positioned at the end of the discharge guide 16 via the drying process and the colorimetric process of the sheet 1*b*. When the end 11*b* runs on the end of the discharge guide 16, the relative distance from the blowoff opening of the blower fan 14 to the sheet 1*b* changes from L1 to L5. When the sheet 1*b* continues to be conveyed in this state, there is a higher possibility that the color patch or the image having been dried makes contact with the drying unit 140 to be rubbed with. Further, when a colorimetric operation by the colorimetric measurement unit U is performed together, since the colorimetric housing 180 goes down from the retreat position La to the measurement position Lb (refer to FIG. 3), the relative distance L5 is further narrowed to remarkably increase the possibility of the contact rubbing.

Therefore according to the present embodiment, as shown in FIG. 6C, immediately after the end 11*b* of the sheet 1*b* passes through the sheet detecting unit 165, the drying unit 140 is retreated to the second stop position as the relative distance L4 in response to the detection signal. This structure enables avoidance of the contact rub of the color patch or the image with the drying unit 140, while conveying the sheet 1*b*.

In a case where the color patch is printed on a paper floating section, even if the drying unit 140 is retreated to the second stop position as the relative distance L4, since the color patch is close to the blowoff opening of the blower fan 14 due to the paper floating, it is effective for ensuring the drying wind speed. It should be noted that the retreat of the drying unit to the second stop position may be step by step executed to coordinate with the conveyance of the sheet 1*b* in a range where the drying unit 140 does not make contact with the sheet 1*b* by the paper floating.

In a case of thus performing the printing on the kind of the sheet having the strong curling characteristic, the sheet detecting unit 165 is provided at the end of the discharge guide 16 in the discharge downstream side and the drying unit 140 is retreated at discharging based upon the detection result of the sheet detecting unit 165, thus preventing interference of the drying unit 140 with the sheet. This structure can realize the printing apparatus capable of improving the total throughput of the color measurement, as well as of preventing the damage to the printed image.

(Fourth Embodiment)

Hereinafter, a fourth embodiment in the present invention will be explained with reference to the drawings. It should be noted that since a basic structure of the present embodiment is the same as that of the first embodiment, a characteristic structure thereof only will be hereinafter explained. In the present embodiment, there will be explained a structure example where a kind of a sheet having a strong curling characteristic is dried by rotating the discharge guide 16 to shorten the drying time.

Figure 7A:
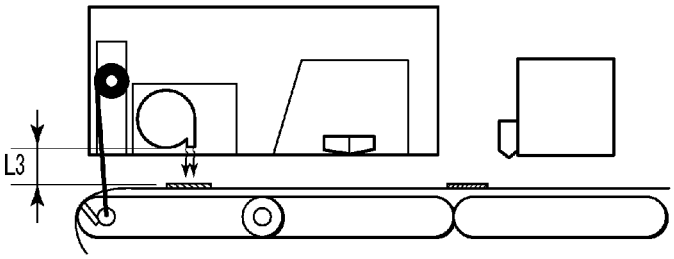
FIG. 7A is a diagram showing the movement of a discharge guide in the present embodiment.
Figure 7B:
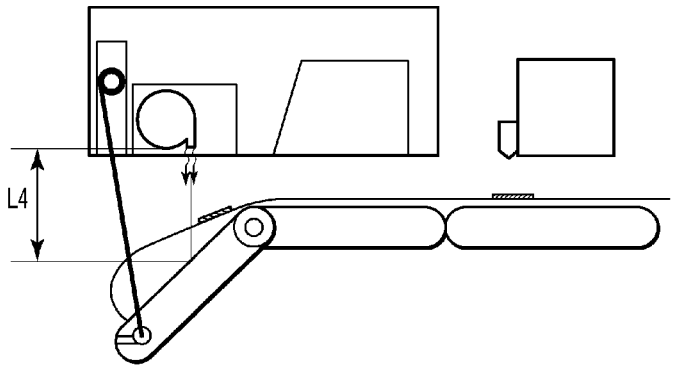
FIG. 7B is a diagram showing the movement of the discharge guide in the present embodiment.

FIG. 7A and FIG. 7B are diagrams showing the movement of the discharge guide according to the present embodiment. FIG. 7A is a state of rotating the discharge guide 16 to a first stop position as the relative distance L3, which is stopped therein, for drying any color patch printed on the sheet 1*b* having a strong curling characteristic by the drying unit 140. The end 11*b* of the sheet 1*b* is in a state before arriving at the sheet detecting unit 165 provided at the front end of the discharge guide 16.

In addition, FIG. 7B shows a state where the sheet 1*b* is further conveyed from FIG. 7A, the end 11*b* passes through the sheet detecting unit 165, and the curled section of the sheet is paper-floated. In this state, the sheet detecting unit 165 detects the passing of the end 11*b*, and the discharge guide 16 is rotated based upon the detection. It should be noted that, as shown in FIG. 2, when the result of the detection by the sheet detecting unit 165 is input to the CPU 300, the CPU 300 controls a discharge guide motor 172 and a discharge guide driving unit 170 to drive the discharge guide 16.

In the present embodiment, when the end 11*b* of the sheet 1*b* runs on the paper-through surface of the discharge guide 16, the paper floating is generated by the curling of the sheet. However, at the same time with the paper floating, the sheet detecting unit 165 detects the end 11*b*, and the discharge guide 16 is rotated in response to the detection signal, therefore making it possible to retreat the discharge guide 16 to the second stop position as the relative distance L4. This structure enables avoidance of the contact rub of the color patch or the image with the drying unit 140, while conveying the sheet 1*b*.

In a case where the color patch is printed on a paper floating section, even if the discharge guide 16 is retreated to the second stop position as the relative distance L4, since the color patch of the sheet 1*b* is closer to the blowoff opening of the blower fan 14 by the paper floating, it is effective for ensuring the drying wind speed. It should be noted that the retreat of the discharge guide 16 to the second stop position where the relative distance becomes L4 may be step by step executed to coordinate with the conveyance of the sheet 1*b* in a range where the discharge guide 16 does not make contact with the sheet 1*b* by the paper floating.

In addition, in the third embodiment and the present embodiment, the sheet detecting unit 165 is shown as an example of performing the paper end (sheet end) detection, but besides, a detection sensor 4*a* (refer to FIG. 1 and FIG. 2) may be used. In this case, the detection sensor 4*a* detects a paper end of the sheet 1*b* at printing start, and a position of the paper end can be calculated from the detection position, feeding and returning amounts of the conveyance roller, and a design value from the detection sensor 4*a* to the end of the discharge guide 16.

Further, the sheet detecting unit 165 and the detection sensor 4*a* may be structured at the same time. In this case, the paper end position calculated from the detection result of the detection sensor 4*a* is compared with an actual paper end position detected by the sheet detecting unit 165 in the CPU 300 for calculation. Since a feeding-returning error of the sheet can be calculated from the comparison result to be stored in the RAM 304, the error amount is used as an offset to the detection result of the detection sensor 4*a*, and thereby the calculation value of the paper end position by the detection sensor 4*a* is found with more accuracy.

Further, the detecting unit of the paper end as the sheet detecting unit 165 or the detection sensor 4*a* may be applied to the first or second embodiment. In this case, since the retreat of the drying unit 140 and the discharge guide 16 can be executed immediately after drying the final color patch, the discharge operation of the sheet 1*a* or the sheet 1*b* can be performed at the same time with the colorimetric completion.

The discharge guide 16 rotatable with the drivable drying unit 140 may be structured to be used at the same time. In this case, since a stroke amount for driving and rotating both can be reduced, the saving space can be performed.

Figure 8:
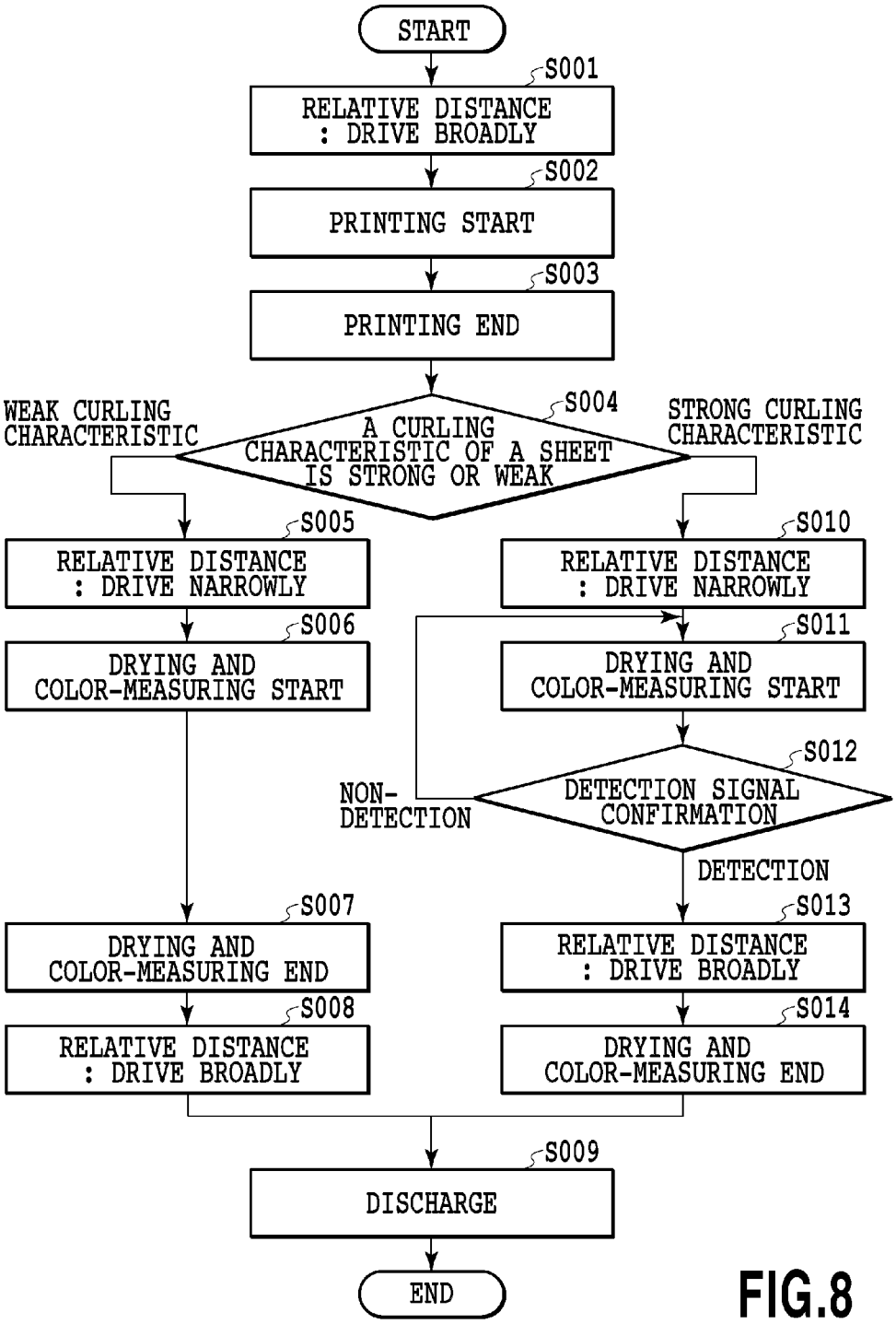
FIG. 8 is a flow chart showing a flow from printing to discharging.

FIG. 8 is a flow chart showing a flow from printing to discharging in the present embodiment. Hereinafter, the flow from printing to discharging will be explained with reference to the flow chart. When start of the printing, drying and colorimetric processes is executed by a user, at step S001, at least one of the drying unit and the discharge guide is driven and rotated to broaden a relative distance between the drying unit and the discharge guide for being positioned. Thereafter, at step S002 printing is performed on a sheet, and at step S003 the desired printing is completed to end the printing process. Thereafter, at step S004 it is selected whether the kind of the sheet on which the printing is performed is the sheet of the kind having a strong curling characteristic or a weak curling characteristic.

In a case where the selection at step S004 indicates the kind of the sheet having the weak curling characteristic, at step S005 a position of at least one of the drying unit and the discharge guide is changed to be positioned in such a manner as to narrow the relative distance between the drying unit and the discharge guide. Therefore at step S006 the drying process and the colorimetric process are executed while maintaining the relative distance, and at step S007 the drying process and the colorimetric process are completed. At step S008 a position of at least one of the drying unit and the discharge guide is changed to be positioned in such a manner as to broaden the relative distance between the drying unit and the discharge guide. Thereafter at step S009 the sheet to which all the processes are completed is discharged to complete the entire process.

On the other hand, in a case where the selection at step S004 indicates the kind of the sheet having the strong curling characteristic, at step S010 a position of at least one of the drying unit and the discharge guide is changed to be positioned in such a manner as to narrow the relative distance between the drying unit and the discharge guide. Thereafter at step S011 the drying and the color-measuring are started, and at step S012 it is determined whether or not the detecting unit for detecting the end of the sheet detects the end of the sheet.

In a case where the end of the sheet is not detected, the drying and the measuring continue to be performed. In a case where the end of the sheet is detected, the process goes to step S013, wherein a position of at least one of the drying unit and the discharge guide is changed to be positioned in such a manner as to broaden the relative distance between the drying unit and the discharge guide. Thereafter at step S014 the drying process and the colorimetric process are completed, and at step S009 the sheet to which all the processes are completed is discharged to complete the entire process.

(Fifth Embodiment)

Hereinafter, a fifth embodiment in the present invention will be explained with reference to the drawings. It should be noted that since a basic structure of the present embodiment is the same as that of the second embodiment, a characteristic structure thereof only will be hereinafter explained. In the present embodiment, an explanation will be made of a printing apparatus having the structure of automatically selecting the drying row number N based upon a relative distance between the drying unit 140 and the discharge guide 16, and a length of the color patch in the paper conveyance direction (patch size Y).

(Explanation of a Change in a Drying Range by a Change in a Relative Distance Between the Drying Unit and the Discharge Guide)

Figure 9:
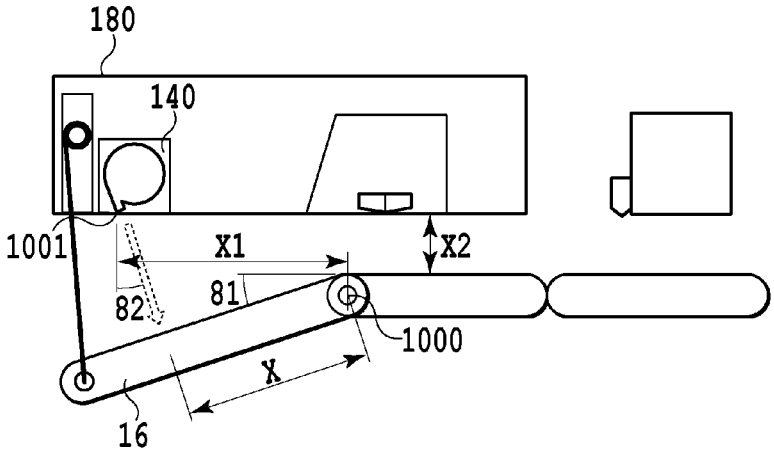
FIG. 9 is a diagram showing explaining a changing drying range.

A drying range X is changed by a change in a relative distance between the drying unit 140 and the discharge guide 16. FIG. 9 is a diagram for explaining the changing drying range X. When an angle of the discharge guide 16 is indicated at θ1, a rotational center of the discharge guide 16 is indicated at 1000, a horizontal distance from the rotational center 1000 to a blowoff opening 1001 of the blower fan 14 is indicated at X1, a blowoff angle is indicated at θ2, and a perpendicular distance between the blowoff opening 1001 and the rotational center 1000 is indicated at X2, the drying range X is shown as the following formula.

$$X = X1 \sin \theta 2 - X2 \sin \theta 1 \qquad \text{(Drying range formula)}$$

As described above, when the relative distance between the drying unit 140 and the discharge guide 16 changes, that is, when the angle θ1 of the discharge guide 16 changes, the drying range X changes, whereby the drying row number N which can be arranged within the drying range X changes. According to FIG. 9 and the above drying range formula, when the angle θ1 of the discharge guide 16 increases, the drying range X becomes narrower, whereby the drying row number N which can be dried at one time decreases. That is, the number of times of drying increases, which has an influence on the colorimetric throughput.

(Explanation that a Drying Efficiency Changes with a Patch Size)

Figure 10A:
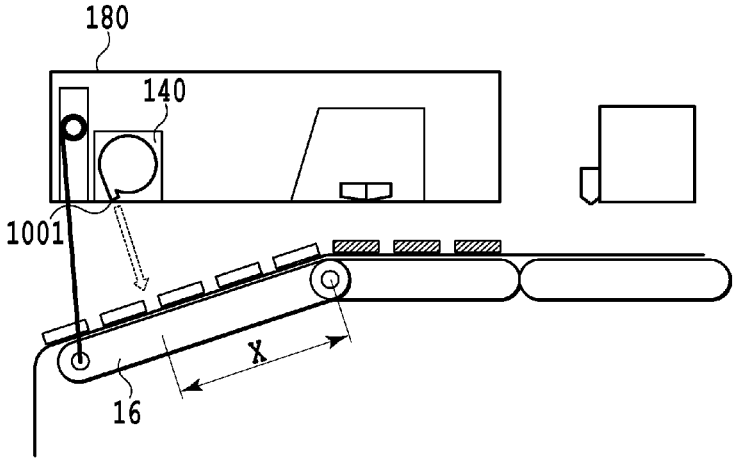
FIG. 10A is a diagram showing the drying row number to be changed by a patch size.
Figure 10B:
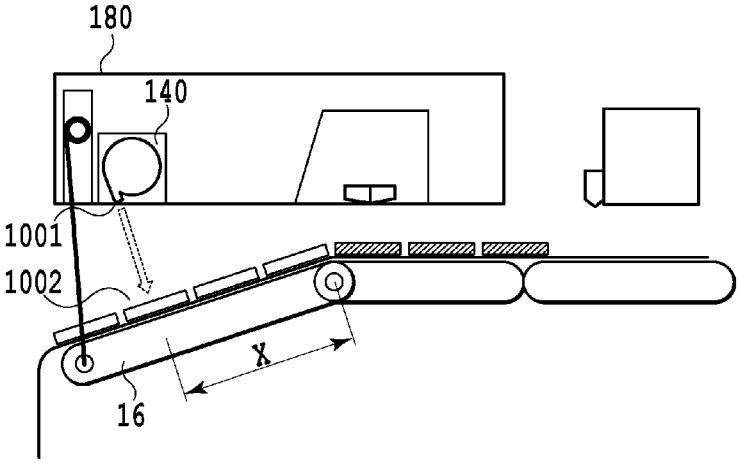
FIG. 10B is a diagram showing the drying row number to be changed by the patch size.

FIG. 10A and FIG. 10B are diagrams respectively showing the drying process and the colorimetric process in the printing apparatus according to the present embodiment. FIG. 10A differs in the drying row number N depending on the patch size from FIG. 10B. FIG. 10A shows the row number equal to the integral multiple of the patch size Y to the drying range X. This case shows a state where since the drying row number N can be arranged without any wasted space within the drying range X, the drying efficiency is maximized. In addition, since all rows of the drying row number N can be dried at one time, the colorimetric accuracy improves.

On the other hand, as shown in FIG. 10B, in a case where the patch size Y is larger or smaller than the integral multiple of the patch size Y to the drying range X, the entire region of the patch size Y of the patch row 1002 the nearest to the blowoff opening 1001 of the blower fan 14 can not be dried within the drying range. In this case, a non-dried region is generated in this patch row, which differs in color stability from the other patch row, giving an influence on the colorimetric accuracy.

As described above, the drying row number N capable of being dried at one time within the drying range X differs depending on the change in the drying range by the change in the relative distance between the drying unit 140 and the discharge guide 16, and the patch size Y. Therefore the drying efficiency changes, and the colorimetric accuracy is affected.

(Explanation of Selecting the Drying Row Number from a Set Table in Advance Set)

Figure 11:
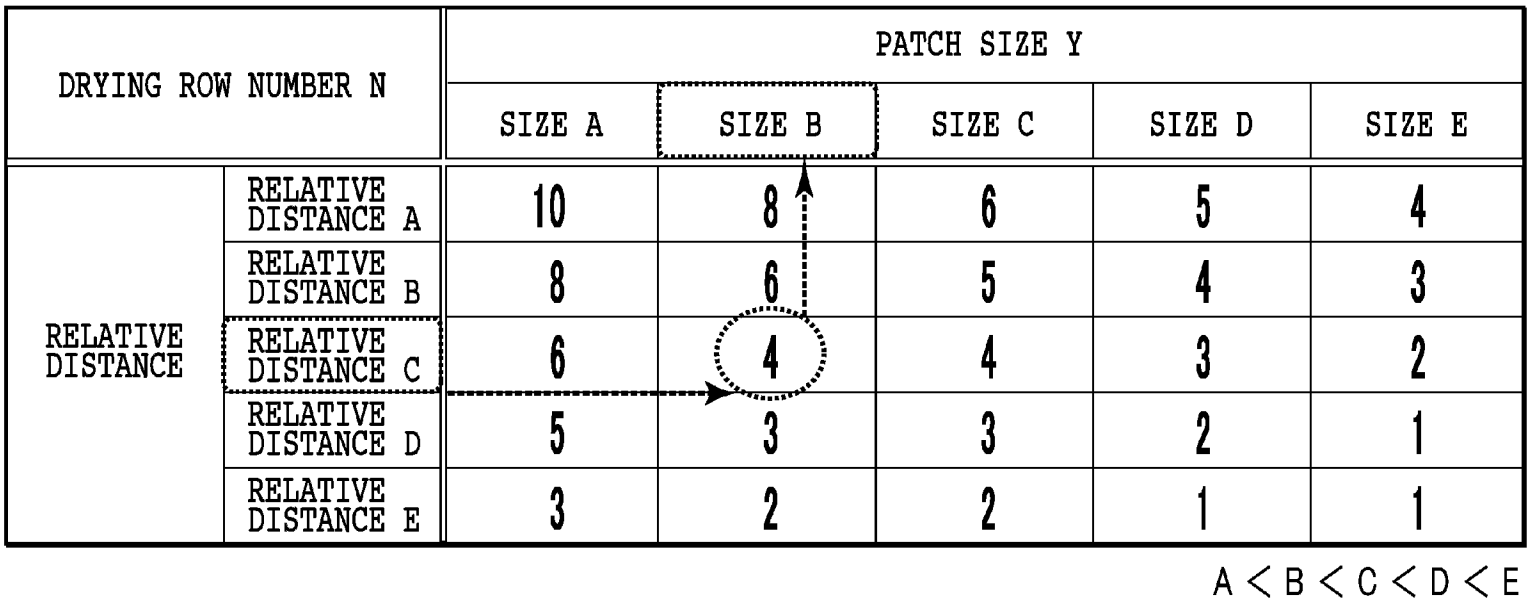
FIG. 11 is a diagram explaining a table for selecting the drying row number.

FIG. 11 is a matrix table (preset condition) showing the drying row number changing with the relative distance and the patch size Y. In the present embodiment, to the drying efficiency changing with the relative distance and the patch size Y, as shown in FIG. 11, there is in advance set a matrix table in which an optimal drying row number can be selected from the relative distance and the patch size Y. In addition, the printing apparatus according to the present embodiment comprises the structure in which the drying row number N can be automatically selected to each setting of a user. Automatic selection of the drying row number N within the drying range by the preset matrix table allows an improvement on the drying efficiency and the usability.

(Explanation of the Drying Row Number Found from a Drying Range Calculated from a Relative Distance Between a Drying Unit and a Discharge Guide, and a Patch Size)

In addition, the present embodiment has the feature of, aside from the selection from the above matrix table, being applicable to the structure in which the drying row number can be selected from the drying range X calculated from the relative distance and the patch size Y. Specifically the integral multiple of the patch size Y to the drying range X is selected as the drying row number N. That is, the drying row number N capable of being dried at one time is an integral number of (drying range X)÷(patch size Y). In this case, as compared to the selection from the above matrix table, the optimal drying row number N can be selected also to the relative distance and the patch size Y in more detail, and the drying efficiency can be further improved.

Figure 12:
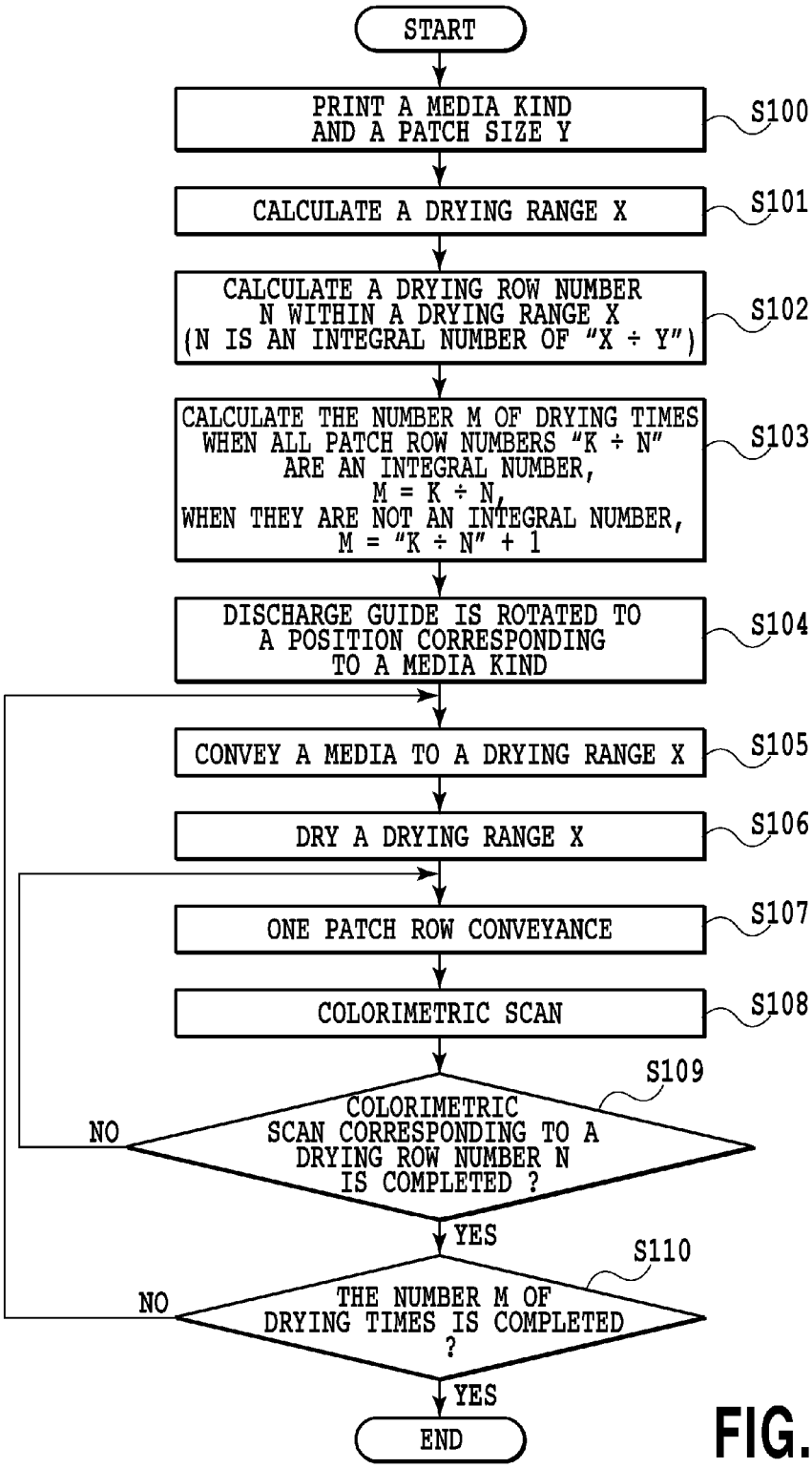
FIG. 12 is a flow chart showing a flow for calculating the drying row number and measuring.

FIG. 12 is a flow chart showing the steps of selecting the drying row number N based upon the calculation of the drying range X, and from drying to color-measuring. Hereinafter, the process of the steps from drying to measuring will be explained with reference to the flow chart.

At step S100 a media kind for color measurement and a patch size set by a user are printed. At step S101 in consideration of the angle of the discharge guide 16 in advance set corresponding to the set media kind, the drying range X is calculated according to the aforementioned drying range formula. At step S102 the drying row number N within the drying range X is calculated from the drying range X calculated at step S101 and the patch size Y set by a user as the integral number of (drying range X÷patch size Y).

Next, at step S103, the number M of drying times is calculated. When "all the patch row numbers÷the drying row number" is equal to the integral number, "the number M of drying times" is made to be equal to "all the patch row numbers K÷the drying row number N". On the other hand, when it is not the integral number, "the number M of drying times" is made to be equal to "all the patch row numbers÷the drying row number"+1. At step S104 the discharge guide 16 is rotated to a position corresponding to the set media kind. At step S105, the media is conveyed such that the calculated drying row number N is arranged within the drying range X, and at step S106 an inside of the drying range X is dried for a given time by the blower fan 14.

After drying, at step S107 the drying row number N is conveyed by one patch row, and at step S108 is scanned for color-measuring. After the color measurement for the drying row number N is completed at step S109, at step S110 the drying to color-measuring process is completed by repeating step S105 to step S109 corresponding to the number M of the drying times.

(Explanation for Calculating a Patch Size from a Relative Distance)

On the other hand, the present embodiment has also the structure in which, by selecting the relative distance by a user when the user sets a patch size Y, the patch size Y having an excellent drying efficiency is shown to the user for selection. To a guarantee patch size Y0 for each media kind in advance set and the drying range X calculated from the relative distance, an optimal patch size to be calculated (optimal patch size Y1) is shown as follows.

"Optimal patch size *Y1*"="guarantee patch size *Y0*"+ "*a*" (*a* is a real number equal to or more than zero)

"a" is calculated such that "drying row number N"="drying range X"+"optimal patch size Y1" becomes an integral number or the extra becomes equal to or less than a threshold, which derives the optimal patch size Y1.

Showing the optimal patch size Y1 to a user or automatically patch-arranging it allows the user to automatically determine the optimal patch size without considering the drying efficiency. Therefore the usability improves. Alternatively there may be used the structure that, to the relative distance selected by a user, the patch size Y which has the largest drying row number N and the small patch size Y is selected from the matrix table shown in FIG. 1. For example, as shown in FIG. 11, in a case where the selected relative distance is C, size B which has the largest drying row number and the small patch size Y is selected.

(Explanation of a Method for Calculating a Relative Distance from a Patch Size)

On the other hand, the present embodiment includes also the structure that the relative distance between the drying unit 140 and the discharge guide 16 in consideration of the drying efficiency by the selection of the patch size by a user is automatically calculated, which is shown to the user or based upon which the discharge guide 16 is automatically rotated. To a guarantee angle θ0 of the discharge guide 16 for each media kind in advance set and a patch size Y set by a user, an optimal angle to be calculated (optimal angle θ1) is shown as follows.

"Optimal angle θ1"="guarantee angle θ0"+"*b*" (*b* is a real number equal to or more than zero)

A drying range X found from the optimal angle θ1 and the aforementioned drying range formula (X=X1 sin θ2−X2 sin θ1) is used to calculate "b" such that "a value of (drying range X)÷(patch size Y) becomes an integral number or the extra becomes equal to or less than a threshold", which derives the optimal angle θ1. Showing the optimal angle θ1 to a user or automatically rotating the discharge guide 16 allows the user to automatically determine the optimal angle θ1 without considering the drying efficiency. Therefore the usability improves.

As described above, according to the present embodiment, it is possible to provide a printing apparatus which has the structure of being capable of preventing the damage to a printed image and improving the total throughput of color measurement by selecting the efficient drying control. It should be noted that in the present embodiment, the explanation is made of the structure that the relative distance between the drying unit 140 and the discharge guide 16 is variable by rotation of the discharge guide 16, but there may be adopted the structure of changing the relative distance by moving the colorimetric housing 180 including the drying unit 140 upwards and downwards.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2011-256949, filed Nov. 25, 2011, and 2012-180226, filed Aug. 15, 2012, which are hereby incorporated by reference herein in their entireties.

What is claimed is:

1. A printing apparatus comprising:

a printing unit configured to perform printing on a sheet;

a colorimetric measurement unit, provided downstream of the printing unit in a conveyance direction of the sheet, configured to perform colorimetric measurement of the sheet;

a drying unit, provided downstream of the colorimetric measurement unit in the conveyance direction, configured to perform drying of the sheet subjected to the printing by the printing unit; and a mechanism for varying a distance between the drying unit and the sheet, wherein the distance between the drying unit and the sheet is set based upon at least one of an operational mode and a kind of the sheet to be used.

2. A printing apparatus according to claim 1, wherein the distance becomes a first distance at the printing, a second distance shorter than the first distance at the drying, and a third distance longer than the second distance at the time of discharging the sheet having been measured in the colorimetric measurement unit.

3. A printing apparatus according to claim 2, wherein the colorimetric measurement unit, at the measuring, moves to a measurement position having a shorter relative distance to the sheet than a retreat position as a position at the printing, and at the discharging, moves to the retreat position.

4. A printing apparatus according to claim 1, wherein the sheet subjected to the printing by the printing unit is fed toward the downstream side to be dried by the drying unit, next, the sheet is fed back toward the upstream side to be measured by the colorimetric measurement unit, and the sheet having been measured is conveyed toward the downstream side for discharging.

5. A printing apparatus according to claim 4, wherein, for reading plural rows of color patterns formed by the printing unit, step-feeding of the sheet toward the upstream side is repeated to perform readout of each row of the color patterns by the colorimetric measurement unit.

6. A printing apparatus according to claim 1, wherein the mechanism moves the drying unit to a guide unit for supporting the sheet, and the distance changes with the movement of the drying unit.

7. A printing apparatus according to claim 1, wherein the mechanism moves a guide unit for supporting the sheet to the drying unit, and the distance changes with the movement of the guide unit.

8. A printing apparatus according to claim 1, wherein a patch row number within a drying range is selected from a preset condition based upon a distance between the drying unit and a guide unit for supporting the sheet, and a size of a color patch.

9. A printing apparatus according to claim 1, wherein a patch row number within a drying range is calculated for selection, based upon a drying range calculated from a distance between the drying unit and a guide unit for supporting the sheet, and a size of a color patch.

10. A printing apparatus according to claim 1, wherein a size of a color patch is calculated from a distance between the drying unit and a guide unit for supporting the sheet or is selected from a set table.

11. A printing apparatus according to claim 1, wherein a distance between the drying unit and a guide unit for supporting the sheet is calculated corresponding to a size of a color patch for selection.

* * * * *